US005839841A

United States Patent [19]

Inui et al.

[11] Patent Number: 5,839,841

[45] Date of Patent: Nov. 24, 1998

[54] PRINTED DEVICE WITH PAPER-SHIFT CONTROL ADAPTABLE TO DIFFERENT PAPER SIZES

[75] Inventors: Takashi Inui; Tamotsu Nishiura, both of Kawasaki, Japan

[73] Assignee: Fujitsu Limited, Kanagawa, Japan

[21] Appl. No.: 928,471

[22] Filed: Sep. 12, 1997

[30] Foreign Application Priority Data

Mar. 19, 1997 [JP] Japan ..... 9-066913

[51] Int. Cl.[6] ..... B41J 29/18

[52] U.S. Cl. ..... 400/708; 400/616.1

[58] Field of Search ..... 400/708, 707, 400/709, 616.1, 616.2, 616; 101/228; 226/75, 79, 83, 81

[56] References Cited

U.S. PATENT DOCUMENTS 5,018,888 5/1991 Nishimura et al. ..... 400/616.1
5,063,416 11/1991 Honda et al. ..... 226/24
5,139,355 8/1992 Yeager ..... 400/616.1
5,187,258 2/1993 Nishikawa et al. ..... 528/392
5,423,620 6/1995 Tokairin ..... 400/708
5,425,694 6/1995 Negishi ..... 101/228
5,516,220 5/1996 Ishikawa ..... 400/616.1
5,676,479 10/1997 Yamaguchi et al. ..... 400/709

*Primary Examiner*—Eugene H. Eickholt
*Attorney, Agent, or Firm*—Armstrong, Westerman, Hattori, McLeland & Naughton

[57] ABSTRACT

A device for printing on a continuous sheet includes a motor for carrying the continuous sheet, a switching unit for switching a minimum unit of control of the motor depending on a paper size of the continuous sheet, and a position-detection unit for detecting a rotational position of the motor. The device further includes a stop-control unit for controlling the motor to stop at a position matching a selected minimum unit of control based on the rotational position of the motor detected by the position-detection unit.

12 Claims, 8 Drawing Sheets

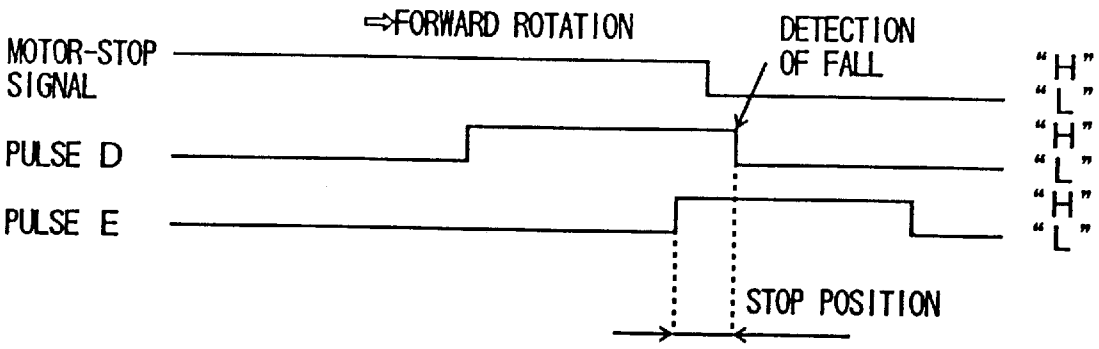
FIG. 4A
FIG. 4B
FIG. 4C
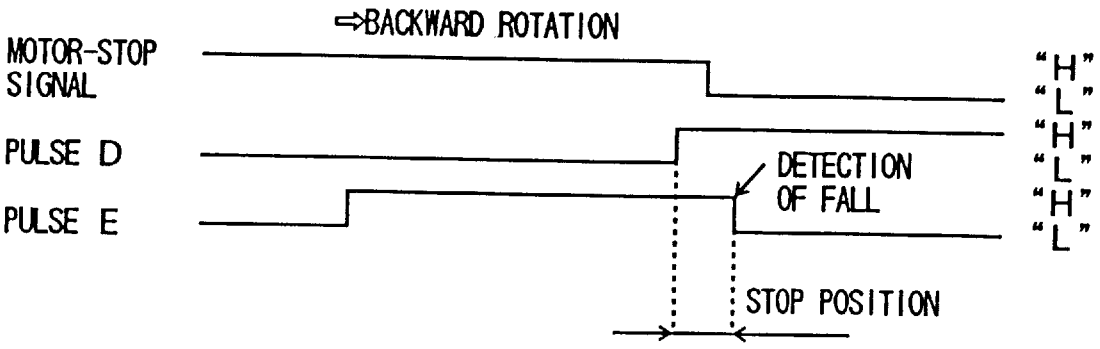
FIG. 5A
FIG. 5B
FIG. 5C

PRINTED DEVICE WITH PAPER-SHIFT CONTROL ADAPTABLE TO DIFFERENT PAPER SIZES

BACKGROUND OF THE INVENTION

1. Field of the Invention

The present invention generally relates to printer devices, and particularly relates to a continuous-sheet printer device for printing on a continuous print sheet.

2. Description of the Related Art

Printer sheets used by printing devices generally include two types of sheets. One type of sheet is a separate sheet such as an A4-size (one of Japanese standard paper sizes) sheet or a legal-size sheet, and the other type of sheet is a continuous sheet which is comprised of a number of sheets connected in series with boundary perforations. The continuous sheet is provided with sprocket holes at the margins of its side ends, and these sprocket holes are hooked to tractor pins of a printer device so that the printer device can lead the continuous sheet inside the device.

When a printer device prints on a continuous sheet, stop positions of the continuous sheet must be such that boundary perforations come to stop at an appropriate position. If the boundary perforations are not placed at this appropriate position, a next print operation will start printing at a wrong printing position. Continuous sheets used in Japan have various sizes (a length between perforated boundaries) such as 11 inches, 12 inches, and 12.5 inches. Other countries such as the United States, however, use continuous sheets having different sizes from those used in Japan. In the United States, for example, a continuous sheet having a size of 11⅓ inches is often used. In accordance with the paper sizes, printer devices commercially available in Japan have a minimum unit of ½ inch with regard to control of paper shift and stop positions, while printer devices used in the United States have a minimum control unit of ⅙ inch.

Even in Japan, there is a case in which one wishes to print on a continuous sheet having one of the U.S.-standard sizes. The printer devices with the minimum unit of ½ inch, however, cannot control the paper shift and stop positions by the unit of ⅙ inch. In this case, one suffers an inconvenience in that print positions are displaced.

If step motors are used for carrying a print sheet, a flexible rotation control can be achieved. Use of step motors, however, has problems in that torques are weak in a range of high rotation rate and in that it takes some time before bringing the motor to a range of high rotation rate. Use of DC motors is thus necessary in order to have sufficient torques in a high-speed range. The DC motor, however, has its own disadvantage in that the use of it results in difficulties in controlling stop positions.

Accordingly, there is a need for a device for carrying a continuous sheet in which a change can be made to a minimum unit for controlling paper shift and stop positions.

SUMMARY OF THE INVENTION

Accordingly, it is a general object of the present invention to provide a device which can satisfy the need described above.

It is another and more specific object of the present invention to provide a device for carrying a continuous sheet in which a change can be made to a minimum unit for controlling paper shift and stop positions.

In order to achieve the above objects according to the present invention, a device for printing on a continuous sheet includes a motor for carrying the continuous sheet, a switching unit for switching a minimum unit of control of the motor depending on a paper size of the continuous sheet, and a position-detection unit for detecting a rotational position of the motor. The device further includes a stop-control unit for controlling the motor to stop at a position matching a selected minimum unit of control based on the rotational position of the motor detected by the position-detection unit.

In the device described above, a minimum unit of motor control can be switched according to the size of the continuous sheet, and the motor is controlled to stop at a position matching the selected minimum unit of control based on the rotational position of the motor detected by a position-detection means. Therefore, stop positions of the continuous sheet can be controlled to match the ½-inch control, the ⅙-inch control, or any unit of control, thereby coping with various sizes of continuous sheets.

According to one aspect of the present invention, the rotation of the motor is controlled based on the selected minimum unit of control to control the amount of paper shift, so that the amount of paper shift can match the ½-inch unit, the ⅙-inch unit, or any unit. Further, an acceleration gain, a constant-speed gain, and a deceleration gain are changed according to the selected minimum unit of control, so that appropriate acceleration and deceleration can be achieved in accordance with the selected minimum unit of control.

Other objects and further features of the present invention will be apparent from the following detailed description when read in conjunction with the accompanying drawings.

BRIEF DESCRIPTION OF THE DRAWINGS

FIGS. 4A through 4C are illustrative drawings for explaining the control of stop positions by a motor-stop-position control circuit shown in FIG. 1;

FIGS. 5A through 5C are illustrative drawings for explaining the control of stop positions by the motor-stop-position control circuit shown in FIG. 1;

DESCRIPTION OF THE PREFERRED EMBODIMENTS

In the following, embodiments of the present invention will be described with reference to the accompanying drawings.

Figure 1:
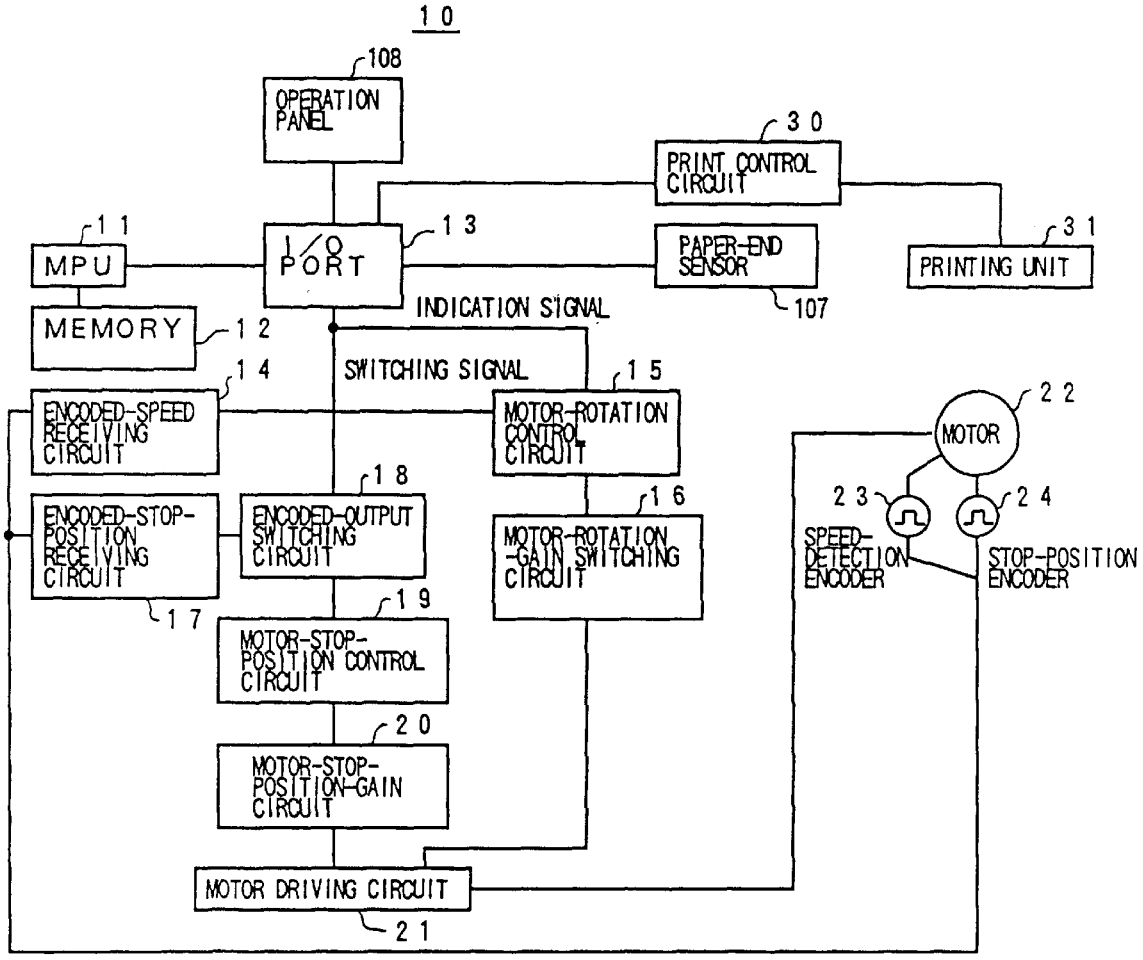
FIG. 1 is a block diagram of an embodiment of a printer device according to the present invention.

FIG. 1 is a block diagram of an embodiment of a printer device according to the present invention.

A printer device 10 of FIG. 1 includes an MPU (micro processing unit) 11, a memory 12, an I/O port 13, an encoded-speed receiving circuit 14, a motor-rotation control circuit 15, a motor-rotation-gain switching circuit 16, an encoded-stop-position receiving circuit 17, an encoded-output switching circuit 18, a motor-stop-position control circuit 19, a motor-stop-position-gain circuit 20, a motor driving circuit 21, a motor 22, a speed-detection encoder 23, a stop-position encoder 24, a print control circuit 30, and a printing unit 31.

The MPU 11 collects necessary information for printing from the I/O port 13 based on procedures stored in the memory 12, Further, the MPU 11 controls the entire operation of the printer device 10.

The encoded-speed receiving circuit 14 receives a series of pulses representing a rotation rate of the motor 22 from the speed-detection encoder 23, which is attached to the motor 22. The received pulse series is supplied to the motor-rotation control circuit 15 as rotation-rate information. The motor-rotation control circuit 15 further receives an indication signal and a switching signal from the MPU 11 via the I/O port 13. The indication signal indicates an on/off state of the motor 22, and the switching signal indicates whether the control is based on a unit of ½-inch or a unit of ⅙ inch, for example. Based on the received information, the motor-rotation control circuit 15 generates an acceleration flag indicating acceleration of the motor 22, a constant-speed flag indicating driving of the motor 22 at a constant speed, and a deceleration flag indicating deceleration of the motor 22. These flags along with the switching signal are sent to the motor-rotation-gain switching circuit 16. Based on the flags and the switching signal, the motor-rotation-gain switching circuit 16 outputs an acceleration gain, a constant-speed gain, and a deceleration gain which define torques of the motor 22. These gains vary depending on whether the control is based on the unit of ½ inch or the unit of ⅙ inch. The motor-rotation-gain switching circuit 16 further outputs a series of pulses (pulse train) which defines the rotational amount of the motor 22 by the number of the pulses. The gains and the pulse train are supplied to the motor driving circuit 21.

The encoded-stop-position receiving circuit 17 receives a pulse signal indicating a rotational position of the motor 22 from the stop-position encoder 24, which is attached to the motor 22. The received pulse signal is supplied to the encoded-output switching circuit 18 as rotational-position information. The encoded-output switching circuit 18 further receives the switching signal from the MPU 11 via the I/O port 13. Based on the switching signal, the encoded-output switching circuit 18 outputs either rotational-position-detection pulses for the unit of ½ inch or rotational-position-detection pulses for the unit of ⅙ inch. Based on a selected type of the rotational-position-detection pulses, the motor-stop-position control circuit 19 outputs a stop flag which controls the stop position of the motor 22. The stop flag is supplied to the motor driving circuit 21.

Based on the gains, the pulse train, and the stop flag, the motor driving circuit 21 controls the motor 22 to accelerate, engage in constant-speed rotation, decelerate, and stop at an adjusted position. The rotation of the motor 22 carries a continuous sheet (not shown). The print control circuit 30 receives instructions from the MPU 11 via the I/O port 13, and performs various controls with regard to printing on the continuous sheet. Under the control of the print control circuit 30, the printing unit 31 performs an actual task of printing on the continuous sheet.

In FIG. 1, a mechanism for switching between the unit of ½ inch and the unit of ⅙ inch is provided as described above. Except for this mechanism, the printer device 10 of FIG. 1 is comprised of conventional circuits for ½-inch control and conventional circuits for ⅙-inch control. In what follows, a description will be provided mainly with respect to the switching mechanism, and a detailed description of the circuits for the ½-inch control or the ⅙-inch control will be omitted.

Figures 2A, 2B, 2C, 2D, 2E, 2F:
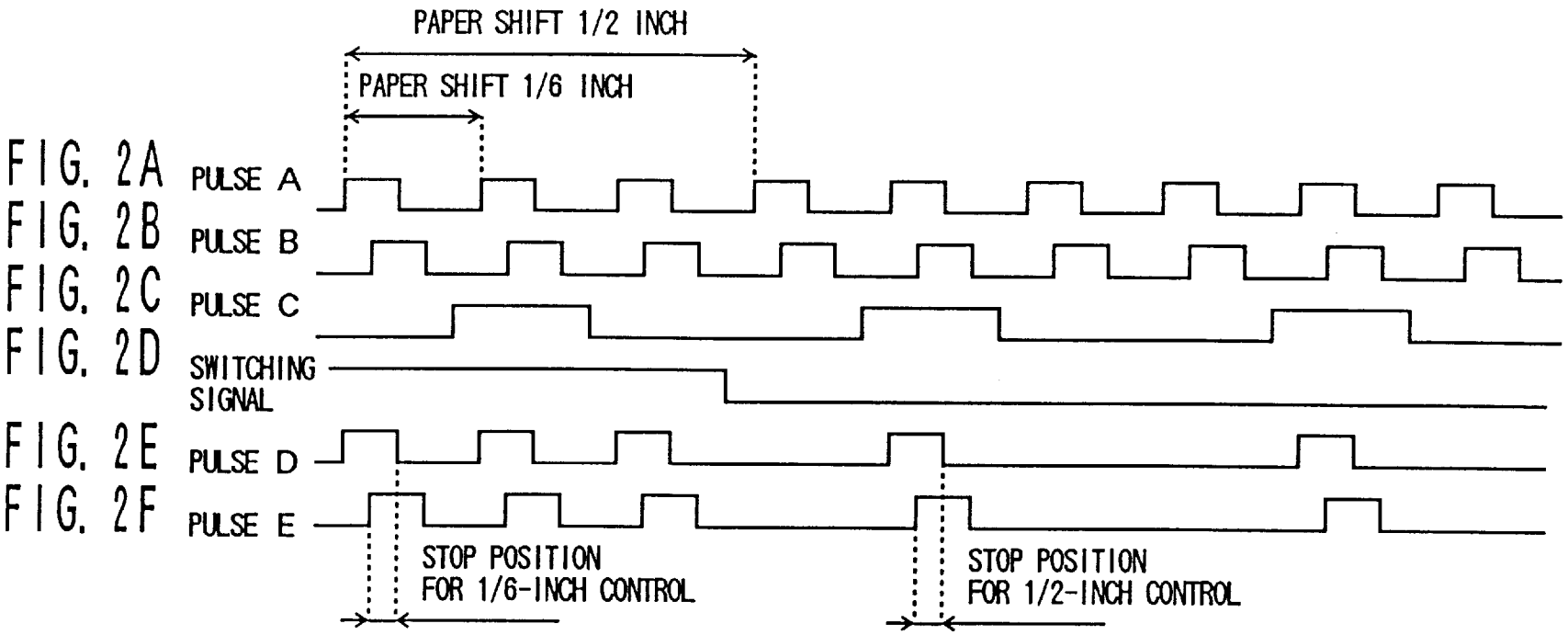
FIGS. 2A through 2F are timing charts showing pulse signals which are used for stop-position control of the motor shown in FIG. 1.

FIGS. 2A through 2F are timing charts showing pulse signals which are used for stop-position control of the motor 22. In FIGS. 2A through 2C, pulses A through pulses C are outputs of the stop-position encoder 24, and indicate a rotational-position of the motor 22. In FIG. 2D, the switching signal indicates whether the unit of control is ½ inch or ⅙ inch. In FIGS. 2E and 2F, pulses D and pulses E are created by using the pulses A through C and the switching signal, and are used for stop-position control of the motor 22.

When the switching signal is HIGH, the pulses A and B are used as the pulses D and E, respectively. When the switching signal is LOW, the pulses A and B are combined with the C pulses serving as a window to generate the pulses D and E, respectively. Namely, only when the pulses C maintain a HIGH level, are the pulses A and B passed through the HIGH-level windows of the pulses C to be presented as the pulses D and E, respectively. As shown in FIGS. 2A through 2C, the pulses C have a HIGH period once in every three cycles of the pulses A and B, so that the pulses D and E when the switching signal is LOW have a cycle three times longer than that of the pulses D and E when the switching signal is HIGH.

Figure 3:
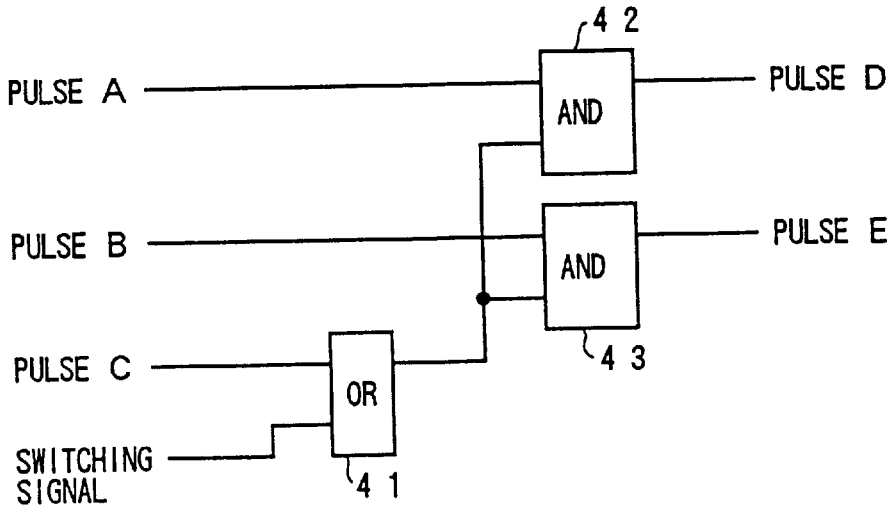
FIG. 3 is a circuit diagram of an example of an encoded-output switching circuit shown in FIG. 1.

FIG. 3 is a circuit diagram of an example of the encoded-output switching circuit 18. The encoded-output switching circuit 18 of FIG. 3 includes an OR circuit 41 and AND circuits 42 and 43. Supplying the pulses A through C of FIGS. 2A through 2C, respectively, to the encoded-output switching circuit 18 of FIG. 3, one can obtain the pulses D and E as outputs as shown in FIGS. 2E and 2F.

As shown in FIG. 2A, one cycle of the pulses A corresponds to a ⅙-inch shift of the print sheet. In other words, if the motor 22 rotates by an rotational amount corresponding to this one cycle, the print sheet is carried a distance of ⅙ inch. If the print sheet is to be carried a distance of ½ inch, therefore, the motor 22 must rotate by a rotational amount corresponding to three cycles.

The pulses D and E are used for controlling the stop position of the motor 22. In detail, the motor 22 is controlled so as to stop at a rotational position where both the pulses D and E become HIGH, as shown at the bottom of FIG. 2F. The reason why both the pulses D and E are used is because there is a need to determine whether a current rotational position is located on one side of the target stop position or the other side of the target stop position. That is, if the motor 22 has a current rotational position which is slightly deviated from the target stop position to the right-hand side in FIGS. 2E and 2F, the pulse D is LOW whereas the pulse E is HIGH. On the other hand, if the current rotational position is slightly displaced to the left-hand side, the pulse D is HIGH while the pulse E is LOW. By using both the pulses D and E in this manner, a direction in which the motor 22 should be rotated can be known when there is a need to bring the rotational position to the target stop position. The control of the rotational position of the motor 22 is performed by the motor-stop-position control circuit 19 of FIG. 1.

FIGS. 4A through 4C are illustrative drawings for explaining the control of stop positions by the motor-stop-position control circuit 19. FIGS. 4A through 4C show a motor-stop signal, a pulse D, and a pulse E, respectively, when the motor 22 rotates in a forward direction (i.e. the direction in which the print sheet is carried). FIGS. 5A through 5C are also illustrative drawings for explaining the control of stop positions by the motor-stop-position control circuit 19. However, FIGS. 5A through 5C show the motor-stop signal, a pulse D, and a pulse E, respectively, when the motor 22 rotates in a backward direction (i.e., a direction reverse to the forward direction).

In FIGS. 5B and 5C, the motor 22 rotates in the backward direction either in order to return to a correct stop position or due to an externally applied force. Because of this, the relative timing between the pulses D and E is reverse to that shown in FIGS. 4B and 4C. In FIGS. 4A through 4C and FIGS. 5A through 5C, the motor-stop signal stops the motor 22 at a point where it changes from HIGH to LOW.

As shown in FIGS. 4A through 4C, when the motor 22 rotates in the forward direction, the pulses D and E are HIGH and LOW, respectively, before the motor 22 reaches its stop position. The pulse E becomes HIGH when the rotation of the motor 22 has reached its stop position. In consideration of this, the motor-stop-position control circuit 19 should control the motor 22 such that the motor 22 stops its rotation when a rise in the pulse E is detected while the pulse D is HIGH. If a fall in the pulse D is detected after the pulse E becomes HIGH, it is an indication that the motor 22 has over-rotated. Accordingly, the motor-stop-position control circuit 19 should control the motor 22 to come back to a correct stop position through reverse rotation if a fall in the pulse D is detected while the pulse E is HIGH.

As shown in FIGS. 5A through 5C, when the motor 22 rotates in the backward direction, the pulses D and E are LOW and HIGH, respectively, before the motor 22 reaches its stop position. The pulse D becomes HIGH when the rotation of the motor 22 has reached its stop position. In consideration of this, the motor-stop-position control circuit 19 should control the motor 22 such that the motor 22 stops its rotation when a rise in the pulse D is detected while the pulse E is HIGH. If a fall in the pulse E is detected after the pulse D becomes HIGH, it is an indication that the motor 22 has over-rotated. Accordingly, the motor-stop-position control circuit 19 should control the motor 22 to come back to a correct stop position through rotation in the forward direction if a fall in the pulse E is detected while the pulses D is HIGH.

The rotation control of the motor 22 shown in FIGS. 4A through 4C and FIGS. 5A through 5C remains effective at all the time while the motor 22 is stationary. In other words, the motor 22 is controlled such that a rotational position is brought back to a correct stop position when a fall in the pulses D or E is detected by the motor-stop-position control circuit 19.

Figure 6A:
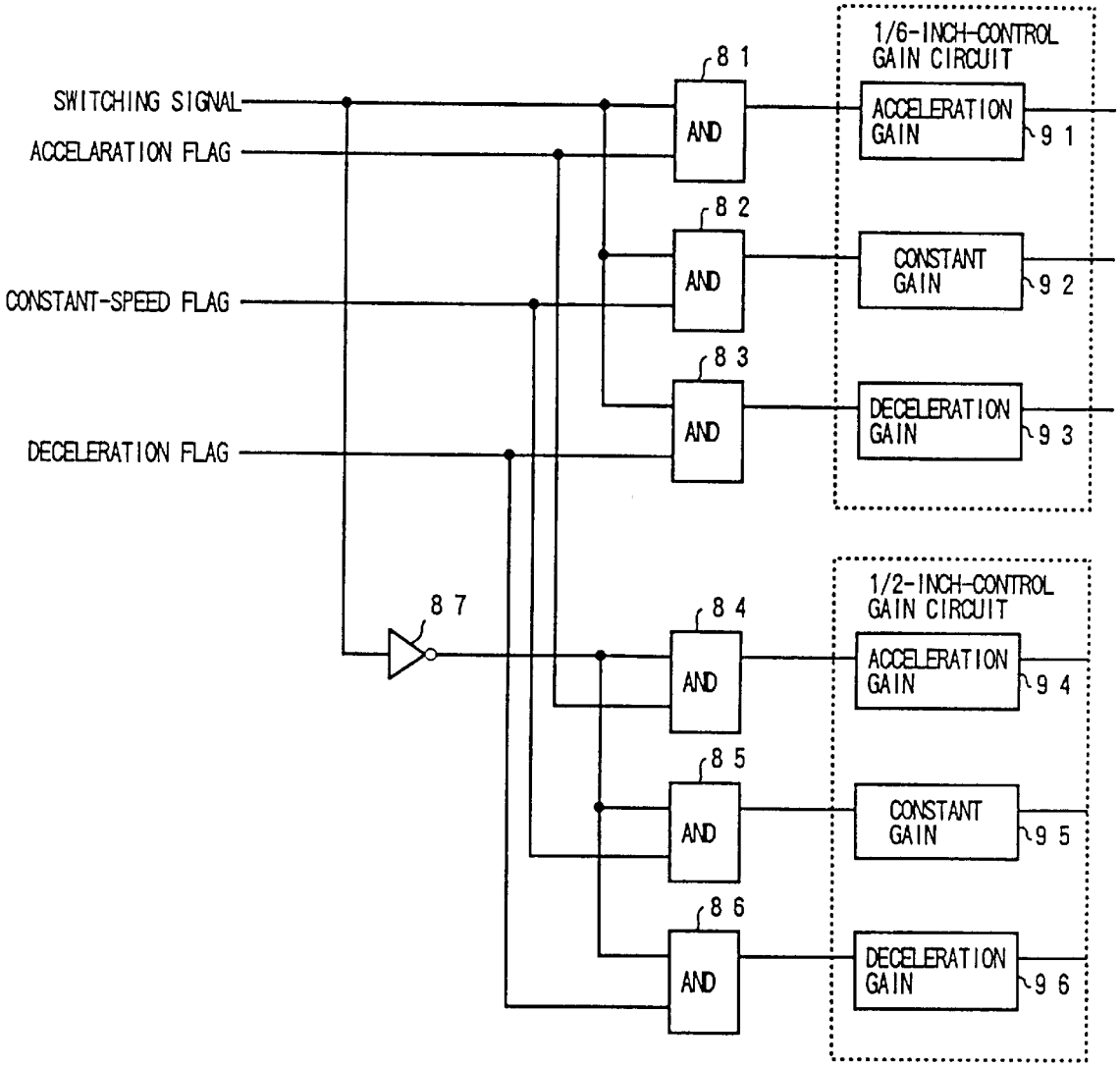
FIGS. 6A and 6B are block diagrams of examples of a motor-rotation-gain switching circuit and a motor-stop-position-gain circuit of FIG. 1, respectively.
Figure 6B:
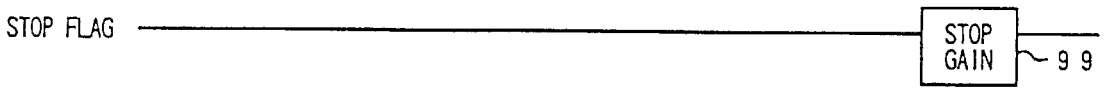

FIGS. 6A and 6B are block diagrams of examples of the motor-rotation-gain switching circuit 16 and the motor-stop-position-gain circuit 20, respectively.

The motor-rotation-gain switching circuit 16 of FIG. 6A includes AND circuits 81 through 86, an inverter 87, acceleration-gain circuits 91 and 94, constant-speed-gain circuits 92 and 95, and deceleration-gain circuits 93 and 96. Each of the gain circuits 91 through 96 outputs a respective gain when a HIGH input is supplied. The gain circuits 91 through 93 together form a ⅙-inch-control gain circuit, whereas the gain circuits 94 through 96 together form a ½-inch-control gain circuit.

As shown in FIG. 6A, the AND circuits 81 through 83 corresponding to the ⅙-inch-control gain circuit receive the switching signal at one input thereof, and receive the acceleration flag, the constant-speed flag, and the deceleration flag at the other input thereof, respectively. When the switching signal is HIGH, the AND circuits 81 through 83 supply the acceleration flag, the constant-speed flag, and the deceleration flag to the acceleration-gain circuit 91, the constant-speed-gain circuit 92, and the deceleration-gain circuit 93, respectively. In this manner, the motor-rotation-gain switching circuit 16 outputs the acceleration gain, the constant-speed gain, and the deceleration gain for use in the ⅙-inch control when the switching signal is HIGH.

Further, the AND circuits 84 through 86 corresponding to the ½-inch-control gain circuit receive the switching signal at one input thereof, and receive the acceleration flag, the constant-speed flag, and the deceleration flag at the other input thereof, respectively. When the switching signal is LOW, the AND circuits 84 through 86 supply the acceleration flag, the constant-speed flag, and the deceleration flag to the acceleration-gain circuit 94, the constant-speed-gain circuit 95, and the deceleration-gain circuit 96, respectively. In this manner, the motor-rotation-gain switching circuit 16 outputs the acceleration gain, the constant-speed gain, and the deceleration gain for use in the ½-inch control when the switching signal is LOW.

As shown in FIG. 6B, the motor-stop-position-gain circuit 20 includes a stop-gain circuit 99, and outputs a constant gain regardless of whether the ½-inch control or the ⅙-inch control is selected. The motor-stop-position-gain circuit 20 controls the motor 22 with regard to the stop position thereof when the motor 22 sufficiently decelerates to come close to a stationary condition. Because of this, the same gain can be used for adjusting the stop position irrespective of whether the ½-inch control or the ⅙-inch control is selected.

Figure 7A:
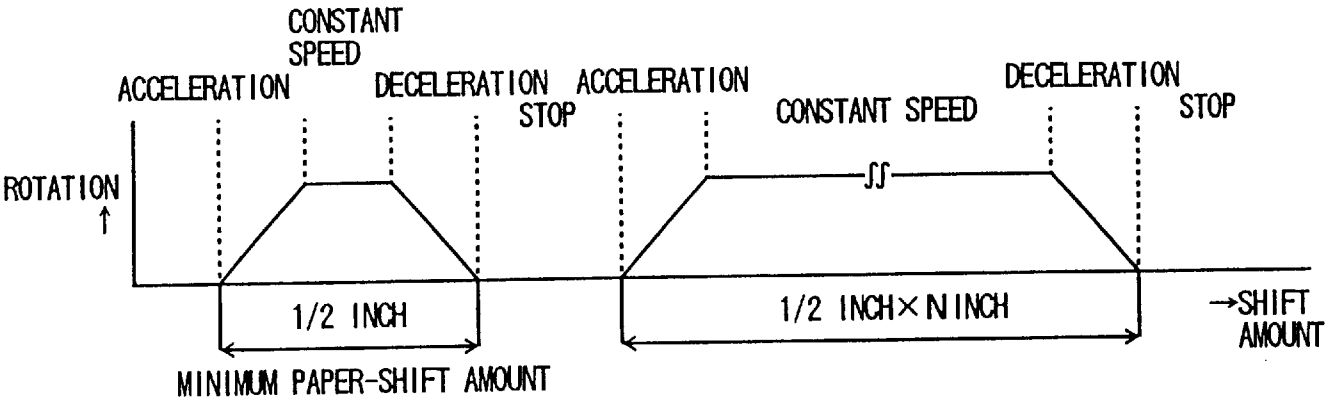
FIGS. 7A and 7B are illustrative drawings showing relations between the amount of paper shift and motor rotation with respect to each of ½-inch control and ⅙-inch control, respectively.
Figure 7B:
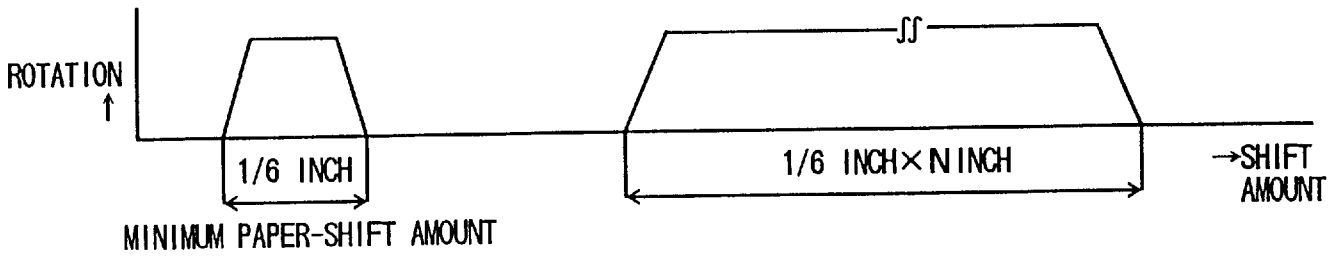

FIGS. 7A and 7B are illustrative drawings showing relations between the amount of paper shift and motor rotation with respect to each of the ½-inch control and the ⅙-inch control, respectively. As shown in FIGS. 7A and 7B, a minimum amount of paper shift is controlled to match the minimum unit of the control. Also, when the sheet is carried by more than the minimum amount of paper shift, the amount of paper shift is controlled to correspond to a multiple of the minimum unit of the control. Further, the acceleration gain and the deceleration gain vary between the ½-inch control and the ⅙-inch control, so that the extent to which the rotation rate increases or decreases at the time of acceleration or deceleration, respectively, can match the minimum amount of paper shift.

As described above, the printer device according to the present invention uses the switching signal to switch the pulse signal for detecting the rotational position of the motor, so that the control of paper shift and stop positions is performed based on the unit of control which corresponds to a size of a continuous sheet used for printing. The unit of control may be stored in the memory 12 of FIG. 1, and may be read by the MPU 11, which in turn outputs the switching signal via the I/O port 13. Alternately, the memory 12 may store a flag corresponding to the unit of control instead of the unit of control per se. The memory 12 may be partially comprised of a nonvolatile memory, so that the unit of control may be determined at the time of shipment from the factory by writing information on the unit of control in the nonvolatile memory. Alternately, a user may use a panel (e.g., an operation panel 108 of FIG. 1) to specify the unit of control or the paper size, so that information on the unit of control is stored in the memory 12. Alternately, the printer device may automatically detect the paper size so as to store information on the unit of control in the memory 12. In this manner, various configurations can be conceived with regard to implementation of the present invention. In the following, one of such configurations will be described.

Figure 8:
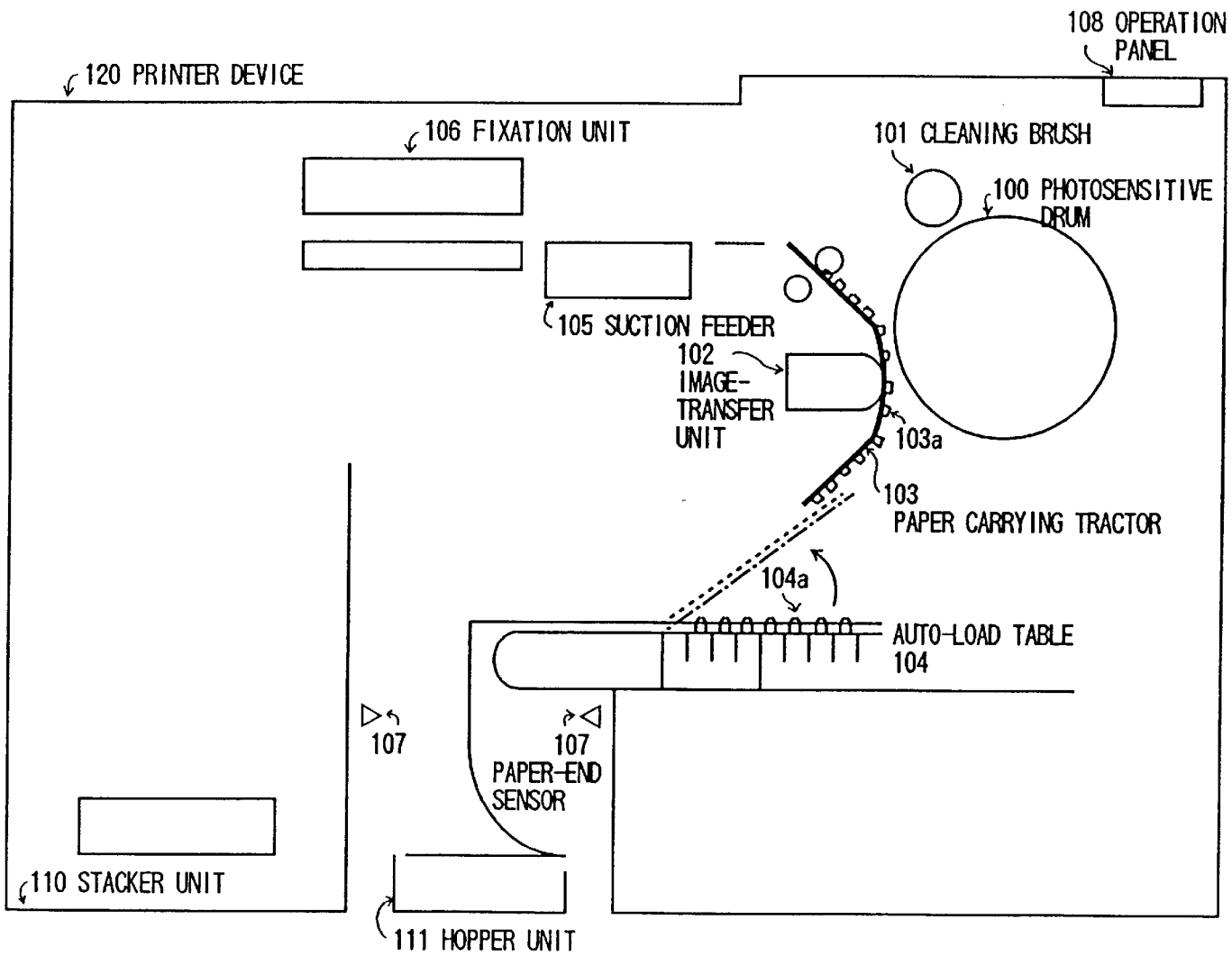
FIG. 8 is an illustrative drawing showing an embodiment of a printer device according to the present invention.

FIG. 8 is an illustrative drawing showing an embodiment of the printer device according to the present invention.

A printer device 120 of FIG. 8 includes a photosensitive drum 100, a cleaning brush 101, an image-transfer unit 102, a paper carrying tractor 103, an auto-load table 104, a suction feeder 105, a fixation unit 106, a paper-end sensor 107, an operation panel 108, a stacker unit 110, and a hopper unit 111. A toner image is formed on the photosensitive drum 100, and the image-transfer unit 102 transfers the toner image onto a print sheet. The paper carrying tractor 103 has tractor pins 103*a* which are fitted into sprocket holes of the print sheet, and carry the print sheet by means of the rotation of the motor 22 (FIG. 1). The suction feeder 105 prevents the print sheet from having slack by sucking air between the print sheet and the suction feeder 105. The fixation unit 106 fixes the toner image on the print sheet. The print sheet bearing the printed image is stored in the stacker unit 110. The hopper unit 111 stores a blank print sheet. The paper-end sensor 107 detects an end of paper storage when the print sheet stored in the hopper unit 111 is used up. The auto-load table 104 is a mechanism for automatically loading the print sheet, and has guide pins 104*a* which are fitted into the sprocket holes of the print sheet. When an auto-load operation is selected after the print sheet is hooked to the guide pins 104*a*, the auto-load table 104 is lifted as shown by an arrow in the figure, and is brought to a position as shown by dotted lines. At this position, the print sheet is hooked to the tractor pins 103*a* of the paper carrying tractor 103. Finally, the paper carrying tractor 103 shifts the print sheet by a predetermined amount to finish preparations for printing. The guide pins 104*a* of the auto-load table 104 and the tractor pins 103*a* of the paper carrying tractor 103 are provided at ½-inch intervals to correspond to the intervals of the sprocket holes of the print sheet. The intervals of the sprocket holes of the print sheet are ½ inch regardless of whether the print sheet is one of the ½-inch type or the ⅙-inch type.

The paper-end sensor 107 is used by a user to specify one of the ½-inch control and the ⅙-inch control, depending on the size of the print sheet. The photosensitive drum 100, the cleaning brush 101, the image-transfer unit 102, the paper carrying tractor 103, the auto-load table 104, the suction feeder 105, the fixation unit 106, and the paper-end sensor 107 correspond to the printing unit 31 of FIG. 1. The motor 22 shown in FIG. 1 rotates the paper carrying tractor 103. The MPU 11 of FIG. 1 controls each element of the printer device 120.

Figure 9:
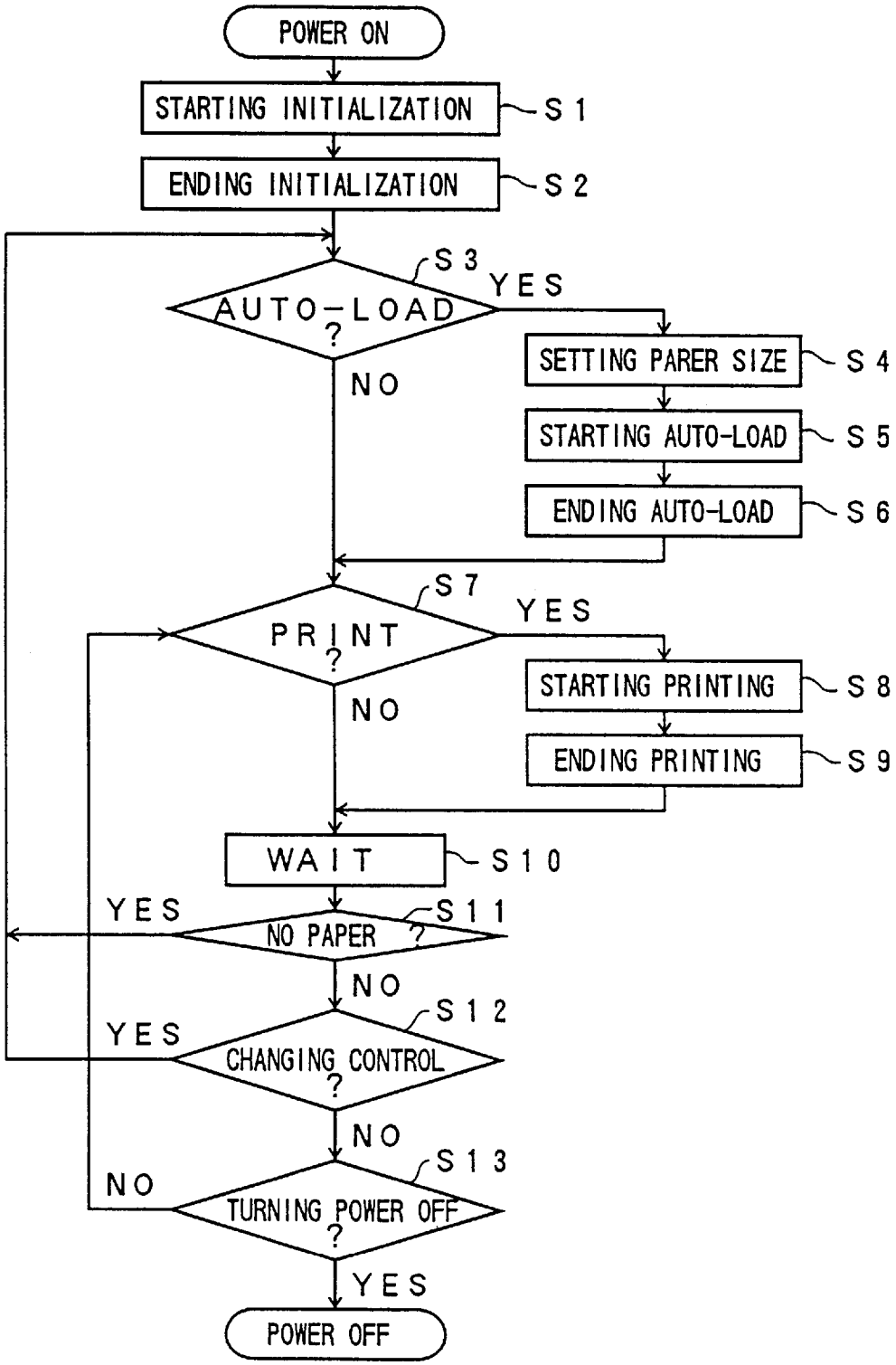
FIG. 9 is a flowchart of an operation of the printer device shown in FIG. 8.

FIG. 9 is a flowchart of an operation of the printer device 120 shown in FIG. 8. With reference to FIGS. 8 and 9, the operation of the printer device 120 will be described below.

After the turning on of the device, at a step Si, an initialization operation is started. This is an operation to prepare for subsequent print operations, and includes discharging of the photosensitive drum 100, preparation of a developing unit (not shown) for insuring a uniform tone of printed characters.

At a step S2, the initialization operation is finished.

At a step S3, a check is made whether to perform an auto-load operation. An instruction as to whether to perform an auto-load operation is given by a user operating the operation panel 108. If an auto-load operation is to be performed, the procedure goes to a step S4. Otherwise, the procedure goes to a step S7.

At the step S4, a setting is made with regard to a paper size. A setting of a paper size is made by the user operating the operation panel 108. The MPU 11 sets a control unit to either ½ inch or ⅙ inch in accordance with the specified paper size.

At a step S5, an auto-load operation is started. The auto-load table 104 is raised so that the print sheet is hooked to the tractor pins 103*a* of the paper carrying tractor 103. When a previously used print sheet is one of the ⅙-inch type, the paper carrying tractor 103 stays in a stop position which matches with the ⅙-inch-unit control. In this case, the stop position may be different from that of the ½-inch-unit control. A continuous print sheet of the ½-inch type has sprocket holes at the same positions with respect to each of the sheets separated along perforations. In a continuous print sheet of the ⅙-inch type, however, a separated sheet has a size which is not a multiple of ½ inch, so that separated sheets have sprocket holes at different positions. Because of this, after printing a last sheet of a ⅙-inch continuous sheet, a stop position of the paper carrying tractor 103 may not coincide with a stop position of the ½-inch control. When the auto-load table 104 is raised, thus, the sprocket holes of the print sheet may not fit the tractor pins 103*a* of the paper carrying tractor 103. In order to avoid this, the present invention adjusts the position of the tractor pins 103*a* so as to cope with the print sheet of the ½-inch type when the paper end is detected. The adjustment is automatically made by resetting the control unit to ½ inch. This ensures that the sprocket holes of the print sheet are hooked to the tractor pins 103*a* of the paper carrying tractor 103 when the auto-load table 104 is lifted. After the tractor pins 103*a* are fitted into the sprocket holes, the paper carrying tractor 103 shifts the print sheet to a print start position. This completes preparations for printing.

At a step S6, the auto-load operation is finished.

At the step S7, a check is made whether to print. An instruction as to whether to print is given by the user operating the operation panel 108. If printing is to be performed, the procedure goes to a step S8. Otherwise, the procedure goes to a step S10.

At the step S8, printing is started. The print sheet is carried by the paper carrying tractor 103 as the motor 22 (FIG. 1) rotates in accordance with the ½-inch control or the ⅙-inch control, depending on the paper size set at the step S4.

At a step S9, the printing is finished. The stop position of the motor 22, i.e., the stop position of the paper carrying tractor 103, is provided at ½-inch steps when the control is based on the ½-inch unit, and is provided at ⅙-inch intervals when the ⅙-inch-control is employed. As described with reference to FIG. 4, the rotational position of the motor 22 is brought back to a correct stop position whenever the motor 22 is displaced due to external force or the like.

At the step S10, the operation enters a phase to wait for a next printing.

At a step S11, a check is made whether the print sheet is used up. The check is made by the MPU 11 based on a signal from the paper-end sensor 107. As previously described, detection of a paper end is followed by an automatic resetting of the control unit to ½ inch in order to shift the tractor pins 103*a* to a stop position of the ½-inch control. If the paper end is detected, the procedure goes back to the step S3. Otherwise, the procedure goes to a step S12.

At the step S12, a check is made whether to change the control unit. If the control unit is to be changed, the procedure goes back to the step S3. Otherwise, the procedure goes to a step S13.

At the step S13, a check is made whether to turn off the power. An instruction as to whether to turn off the power is given by the user operating the operation panel 108. If printing is again to be performed, the procedure goes back to the step S7. If all the printing is finished, the power is turned off. When a power switch is turned off, the control unit currently in use is stored in the memory 12. When the device is turned on next time, the control unit previously used is recovered from the memory 12, and the motor 22 is controlled to move to a correct stop position.

If a paper end is detected by the paper-end sensor 107 during a print operation, the motor 22 is stopped after the print sheet is ejected and the control unit is set to ½-inch.

As described in the above, the printer device 120 can control paper shift and stop positions based on a control unit corresponding to the size of a print sheet while taking into account an auto-load operation and handling of paper-end detection.

According to the present invention as described above, a minimum unit of motor control can be switched according to the size of a continuous sheet, and the motor is controlled to stop at a position matching the minimum unit of control based on the rotational position of the motor detected by a position-detection means. Therefore, stop positions of the continuous sheet can be controlled to match the ½-inch control, the ⅙-inch control, or any unit of control, thereby coping with various sizes of continuous sheets.

Namely, continuous sheets of various sizes can be handled because the stop position of the continuous sheet is controlled based on a selected one of the ½-inch unit, the ⅙-inch unit, and other units.

The rotation of the motor is controlled based on the selected control unit to control the amount of paper shift, so that the amount of paper shift can match the ½-inch unit, the ⅙-inch unit, or any unit, thereby coping with various sizes of continuous sheets.

Further, the acceleration gain, the constant speed gain, and the deceleration gain are changed according to the selected minimum unit of control, so that appropriate acceleration and deceleration can be achieved in accordance with the selected control unit.

Since the motor is adjusted to a position corresponding to the ½-inch-unit control before engaging in auto-loading of a continuous sheet, a continuous sheet of any size can be handled at the time of auto-loading.

When a paper end is detected, the motor is stopped at a position matching the ½-inch-unit control, so that a continuous sheet of any size can be handled at the time of auto-loading.

Further, the unit of control is stored in a memory when the device is turned off, and is recovered from the memory when power is turned on next time so that the rotational position of the motor can be adjusted to the same position as before the turning off of power. That is, displacement of the motor position can be dealt with whether the displacement is created at the time of turning on or turning off or caused by an external force applied during the power down of the device.

Further, the present invention is not limited to these embodiments, but various variations and modifications may be made without departing from the scope of the present invention.

What is claimed is:

1. A device for printing on a continuous sheet, said device comprising:

a motor for carrying said continuous sheet;

switching means for switching a minimum unit of control of said motor depending on a paper size of said continuous sheet;

position-detection means for detecting a rotational position of said motor; and stop-control means for controlling said motor to stop at a position matching a selected minimum unit of control based on said rotational position of said motor detected by said position-detection means.

2. The device as claimed in claim 1, wherein said position-detection means outputs an indication signal which indicates rotational positions matching a minimum unit of control with respect to each of a plurality of paper sizes, and said switching means extracts from said indication signal a position signal which corresponds to the selected minimum unit of control, said position signal being supplied to said stop-control means.

3. The device as claimed in claim 1, further comprising rotation-control means for controlling paper shift by controlling a rotational amount of said motor according to said selected minimum unit of control.

4. The device as claimed in claim 3, wherein said rotation-control means selects an acceleration gain, a constant-speed gain, and a deceleration gain of said motor in accordance with said selected minimum unit of control.

5. The device as claimed in claim 1, wherein said paper size of said continuous sheet varies, and includes a paper size which is a multiple of ½ inch.

6. The device as claimed in claim 5, further comprising auto-load means for auto-loading said continuous sheet, wherein said motor is stopped at a position matching a minimum unit of control of ½ inch before said auto-load means auto-loads said continuous sheet.

7. The device as claimed in claim 5, further comprising paper-end-detection means for detecting an end of said continuous sheet, wherein said motor is stopped at a position matching a minimum unit of control of ½ inch when said paper-end-detection means detects said end of said continuous sheet.

8. The device as claimed in claim 5, further comprising a memory means for storing said selected minimum unit of control, wherein said memory means stores said selected minimum unit of control when power of said device is turned off, and said motor is adjusted to the same position as before turning off of said device based on said selected minimum unit of control stored in said memory when power of said device is turned on.

9. A device for carrying a continuous sheet in a printer, said device comprising:

a motor for carrying said continuous sheet;

a switching means for switching a minimum unit of control of said motor depending on a paper size of said continuous sheet;

position-detection means for detecting a rotational position of said motor; and stop-control means for controlling said motor to stop at a position matching a selected minimum unit of control based on said rotational position of said motor detected by said position-detection means.

10. The device as claimed in claim 9, wherein said position-detection means outputs an indication signal which indicates rotational positions matching a minimum unit of control with respect to each of a plurality of paper sizes, and said switching means extracts from said indication signal a position signal which corresponds to the selected minimum unit of control, said position signal being supplied to said stop-control means.

11. The device as claimed in claim 9, further comprising rotation-control means for controlling paper shift by controlling a rotational amount of said motor according to said selected minimum unit of control.

12. The device as claimed in claim 11, wherein said rotation-control means selects an acceleration gain, a constant-speed gain, and a deceleration gain of said motor in accordance with said selected minimum unit of control.

* * * * *